US005129335A

United States Patent [19]

Lauwers

[11] Patent Number: 5,129,335

[45] Date of Patent: Jul. 14, 1992

[54] FLUID WASTE BURNER SYSTEM

[75] Inventor: Eddy J. Lauwers, Kalmthout, Belgium

[73] Assignee: Union Carbide Industrial Gases Technology Corporation, Danbury, Conn.

[21] Appl. No.: 686,950

[22] Filed: Apr. 18, 1991

[51] Int. Cl.[5] ..... F23G 7/04

[52] U.S. Cl. ..... 110/346; 110/238; 431/5; 431/215; 431/284

[58] Field of Search ..... 110/238, 346, 224; 431/284, 285, 215, 5

[56] References Cited

U.S. PATENT DOCUMENTS

| | | | |
|---|---|---|---|
| 3,718,102 | 2/1973 | Hemsath et al. | 110/7 R |
| 3,822,654 | 7/1974 | Ghelfi | 110/75 |
| 4,544,350 | 10/1985 | Ware, III et al. | 431/285 |
| 4,579,069 | 4/1986 | Gay et al. | 110/342 |
| 4,630,555 | 12/1986 | Guillaume et al. | 110/346 |
| 4,785,748 | 11/1988 | Sudara et al. | 110/346 X |
| 4,863,371 | 9/1989 | Ho | 431/9 |
| 4,915,038 | 4/1990 | Sudara et al. | 110/346 |
| 4,928,605 | 5/1990 | Suwa et al. | 110/261 |
| 4,957,050 | 9/1990 | Ho | 110/346 |

*Primary Examiner*—Edward G. Favors
*Attorney, Agent, or Firm*—Chung K. Pak

[57] ABSTRACT

A process for controlling the temperature and flame front in a liquid waste incinerator comprising: dispersing fluid wastes into the flame of at least one oxygen/fuel burner to incinerate the waste in and around the flame, wherein flame energy is regulated by adjusting the fuel to the low heating value waste ratio to control the flame front and temperature in said incinerator. The flue gas resulting from burning the waste may be used to heat, possibly concentrate partially and/or evaporate (if liquid is present) the fluid waste prior to dispersing it into the flame.

28 Claims, 5 Drawing Sheets

FLUID WASTE BURNER SYSTEM

The present invention pertains to a process and apparatus for controlling the temperature and flame front in waste incinerators. The apparatus includes, inter alia, a novel and improved burner system for incinerating fluid waste streams.

BACKGROUND OF THE INVENTION

Many industrial processes produce fluid waste streams which may contain water and bio- and non-biodegradable components. The non-biodegradable components could be environmentally hazardous materials, such as acids, chlorinated solvents a.o.. Commonly, these fluid waste streams are incinerated in a fixed or rotary furnace. The resulting flue gas from burning these streams is usually treated to remove pollutants, such as CO, $SO_2$, and/or $Cl_2$. Carbon monoxide, for example, can be oxidized to form $CO_2$ while $Cl_2$ and $SO_2$ can be chemically removed, i.e., by reacting them with alkali or alkaline materials. Filtering means may also be used to remove dust if it is present in the flue gas.

It has been known to employ air/fuel burners in a furnace to incinerate fluid waste streams. The air/fuel burners, however, are generally inefficient in burning fluid waste. Much time may be necessary to evaporate water, if present, and then burn the bio- and non-biodegradable components, thereby limiting a rate at which the fluid waste streams are introduced into a furnace for incineration. This problem is compounded by a high volume of a flue gas which usually results from employing air/fuel burners in incinerating the fluid waste. As the volume of a flue gas increases, the throughput of a furnace is decreased. The term "throughput" is defined as "a rate at which a liquid waste stream is fed to a furnace for incineration".

To enhance the throughput of a furnace, the use of oxygen enriched air or lancing pure oxygen in or under the air flame, has been employed. These oxygen techniques, however, are believed to have a number of disadvantages. One of the common disadvantages of pure oxygen lancing includes a partial mixing of the oxygen with the air flame leading to less than the expected increased throughput and to an eventual uncontrollable flame front which could cause possible overheating of downstream filter equipment. Another disadvantage of higher oxygen enrichment levels of the combustion air, is the possible overheating of the furnace refractory in the vicinity of the air flame area.

Therefore, there is a need to find a means by which a throughput rate can be increased without creating unstable and uncontrolled flames and temperature conditions, which could be deleterious to a fluid waste furnace or a liquid waste incinerator and its subsequent communicating off-gas cleaning system.

SUMMARY OF THE INVENTION

The present invention represents an improvement in liquid and/or gaseous waste incineration technology by increasing the throughput capacity of incinerators without causing any harmful effects associated therewith to the incinerator and its subsequent communicating off-gas cleaning system.

This increased throughput capacity is obtained by the "synergetic" effect of several factors influencing the combustion itself and the improved control of the furnace operation, together with shifting from commercial fossil fuel or natural gas to a high heating value liquid and/or gaseous waste as a heat source for the incinerating process.

According to one embodiment of the present invention, this improvement is accomplished in a process and/or apparatus for controlling the temperature and flame front in a waste incinerator comprising: dispersing fluid waste into the flame to incinerate the fluid waste in and around said flame, wherein flame energy is regulated to confine the flame front within said incinerator and to maintain a preselected temperature within the incinerator. The flame is engendered by combusting fuel, such as fossil fuel, natural gas or a high heating value liquid or gaseous waste in the presence of oxygen. The term "flame energy" is therefore, defined by a ratio of the high heating value waste and/or fossil fuel rate to the low heating value fluid waste rate. Such a ratio can be adjusted to confine the flame front within said incinerator and to maintain the preselected temperature in said incinerator since the low heating value fluid waste is being dispersed into the flame.

The fluid waste is introduced into the flame produced by at least one oxygen/fuel burner via at least one nozzle means which is placed within an annulus formed by a housing means surrounding said at least one oxygen/fuel burner. At least one nozzle means may be bent inwardly such that said fluid waste is dispersed into the flame of said at least one oxygen/fuel burner. The fluid waste may comprise a mixture of liquid and gaseous waste, each of which being separately dispersed into the flame of said at least one oxygen/fuel burner through a separate nozzle of said at least one nozzle means. Through the annulus, oxidant is also introduced to stabilize the flame of said at least one oxygen/fuel burner and to enhance the burning of the bio- and non-biodegradable components. Means for imparting a whirling effect to said oxidant such as ribs and baffles can be provided within the annulus.

According to another embodiment of the present invention, this improvement can be achieved in a fluid waste incineration system comprising:

a. a burner system having means for engendering a flame and means for dispersing fluid waste into said flame in a furnace;

b. at least one conduit means for transporting a fluid waste from a fluid waste source to said means for dispersing said fluid waste;

c. a flue gas treating means in communication with the furnace to remove pollutants in the flue gas resulting from burning the fluid waste in the furnace; and d. means for transporting the flue gas from the furnace to heat the fluid waste prior to dispersing the fluid waste into the flame.

The means for engendering the flame comprises at least one oxygen/fuel burner. This oxygen/fuel burner may be in communication with a high heating value waste source which could provide a high heating value waste, as a substitute for fossil fuel, to engender a flame. The means for dispersing the fluid waste comprises at least one nozzle means placed within an annulus formed by a housing means surrounding the oxygen/fuel burner. The means for transporting the flue gas from the furnace to heat the fluid waste include an evaporation system which is in communication with the furnace via conduit means. Means for regulating the liquid waste atomization rate, the oxidant flow rate and the fuel introduction rate are also provided to control the flame of the oxygen/fuel burner and the temperature of the furnace. By using the flue gas to heat a low heating value fluid waste, particularly a low heating value liquid containing waste, which may be partially concentrated as a result of heat, prior to combustion, the reduction of the flue gas or off gases in the furnace by an amount equal to the quantity of water that had been evaporated can be achieved. Combustion is also enhanced.

As used herein the term "fuel" means a high heating value waste, fossil fuel and/or natural gas.

As used herein the term "a high heating value waste" means a waste having a heating value equal to or greater than 3500 Kcal/kg.

As used herein the term "a low heating value waste" means a waste having a heating value of less than about 3500 Kcal/kg.

As used herein the term "fluid waste" means liquid waste, gaseous waste or mixtures thereof.

As used herein the term "oxygen/fuel burner" means an oxygen burner which engenders a flame by combusting fuel in the presence of oxidant having at least 28% oxygen concentration.

DETAILED DESCRIPTION OF THE INVENTION

Figure 1:
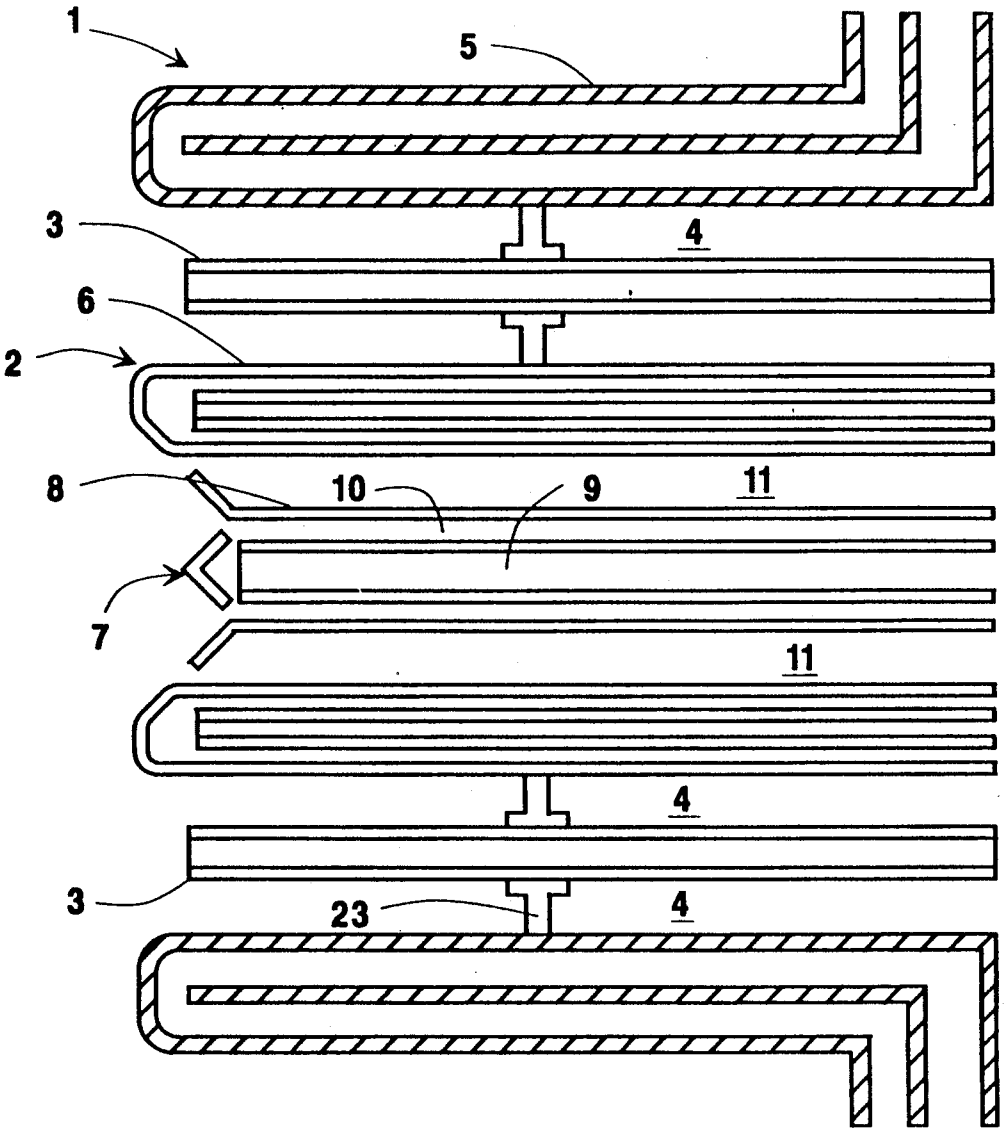
FIG. 1 is a side cross-sectional view of the improved burner system illustrating one embodiment of the present invention.
Figure 2:
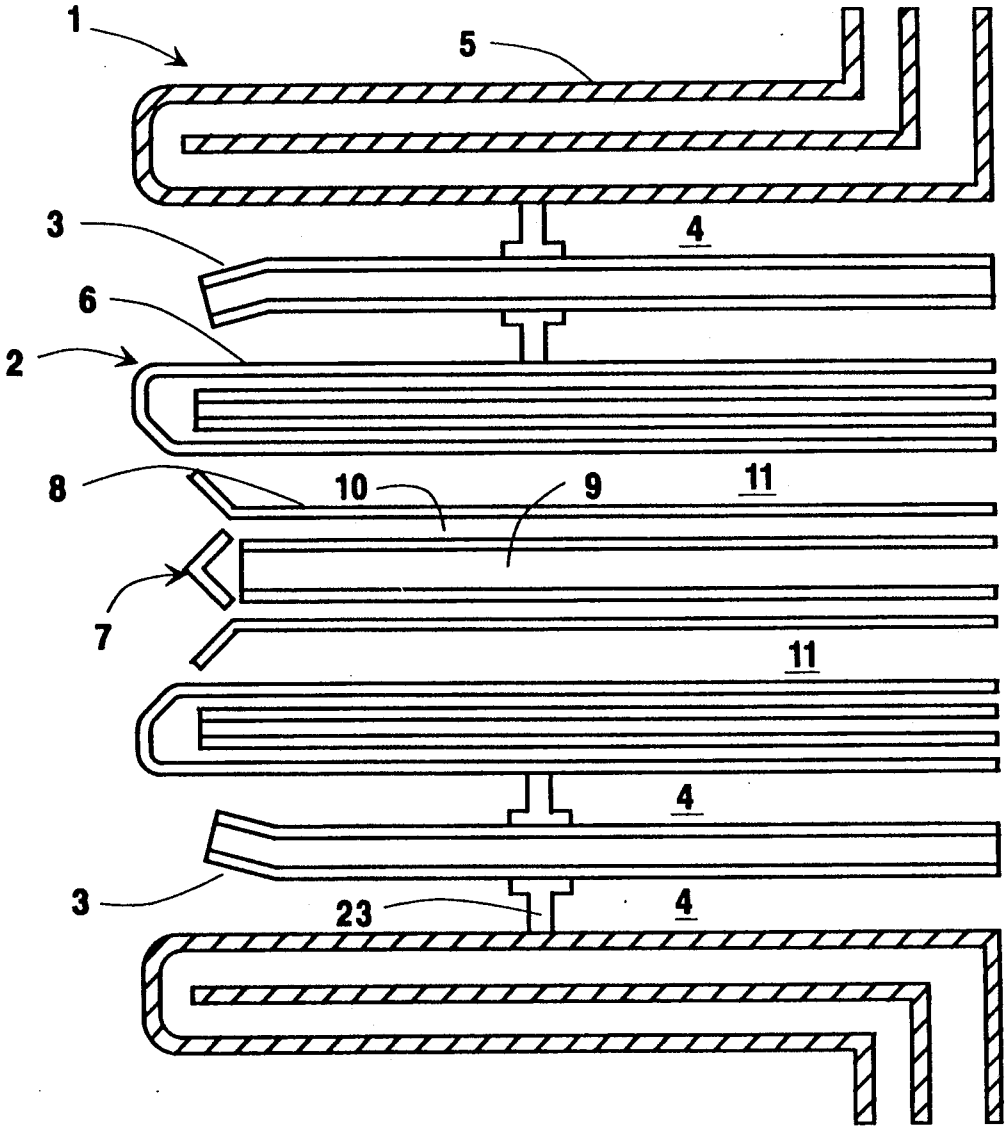
FIG. 2 is a side cross-sectional view of the improved burner system having bent nozzles illustrating one embodiment of the present invention.
Figure 3:
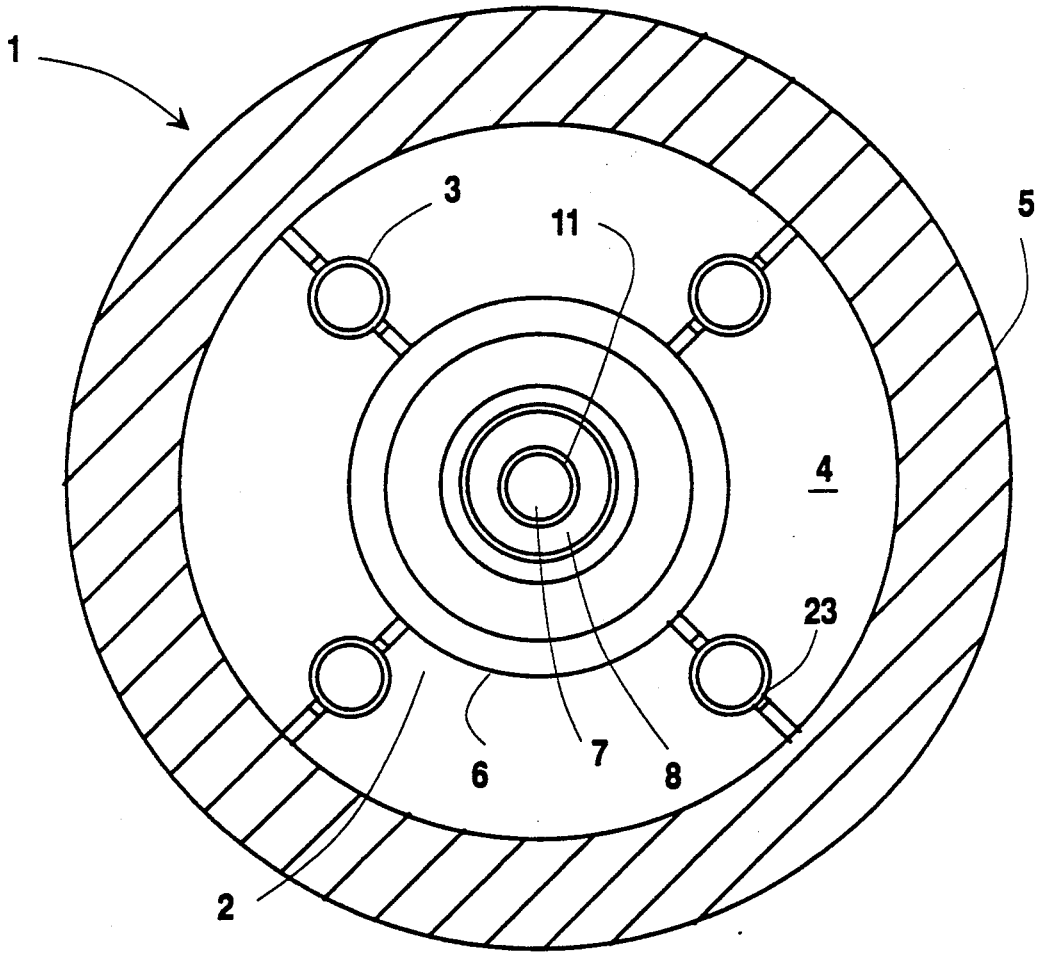
FIG. 3 is an end view of the improved burner system of FIG. 1.

Referring to FIGS. 1–3, a burner system (1) is illustrated in side and end views. The burner system (1) has a centrally located oxygen/fuel burner (2), which is an assembly consisting of the elements numbered 6, 7, 8, 9, 10, 11, as shown in FIG. 1 and FIG. 2, and a plurality of nozzles (3) placed substantially parallel to the centrally located oxygen/fuel burner (2) within a water cooled annulus (4) which is formed by a housing means having a water jacket (5) surrounding the centrally located oxygen/fuel burner (2). The oxygen/fuel burner (2) includes a water cooled cylindrical pipe (6) which protects a concentrically placed inner pipe (8) terminating at a nozzle tip (7) from which fuel or waste is emitted. The inner pipe (8) contains two coaxially placed tubes wherein fuel flows to the nozzle tip (7) through the outer tube or annulus (10) and, air or any other atomizing agent is provided through the central tube (9) to atomize the fuel at the nozzle tip (7).

The preferred oxygen/fuel burner employed is the aspirator burner described and claimed in U.S. Pat. No. 4,378,205—Anderson or U.S. Pat. No. 4,541,796—Anderson, which is releasably mounted in the burner system (1). The location of this oxygen/fuel burner (2) is such that it is in the center of the burner system (1) with its tip (7) terminating at about 0 to about $0.3^m$ retracted behind the tips of the plurality of nozzles (3). The oxidant employed in the oxygen/fuel burner and flowing through the annulus (11) is preferably technically pure oxygen having an oxygen concentration greater than 99.5 percent. The oxidant having an oxygen concentration greater than 50 percent, however, can be employed. The oxidant flowing through the annulus (4) may be technically pure oxygen having an oxygen concentration greater than 99.5 percent or it may be air or oxygen-enriched air having an oxygen concentration of at least 21 percent or preferably greater than 30 percent. The preferred fuel employed is the rich fossil fuel such as oil, natural gas, or high heating value fluid waste having a heating value of above 3500 kcal/kg.

The plurality of nozzles (3) may also be releasably mounted within the annulus (4) of the burner system (1). Each nozzle (3) can be bent inwardly toward the oxygen/fuel burner (2), a preferred bent angle being 0° to 40°, measured from the central axis of each nozzle. The passageway of each nozzle (3) is such that small solid particles of up to 5 mm diameter or larger can pass through the nozzle (3). Through these nozzles, a low heating value fluid waste is dispersed into the flame of at least one oxygen/fuel burner. Different low heating value waste, such as gaseous or liquid waste, may be separately introduced into the flame through separate nozzles of said plurality of nozzles (3).

The waste streams entering the burner system (1) and passing through the nozzle tip (7) and the nozzles (3) preferably originate from different sources and may therefore have different qualities with respect to composition, heating value, viscosity etc. These waste streams, however, may be derived from the same source. One of the streams could be treated to provide a high heating value.

Figure 4:
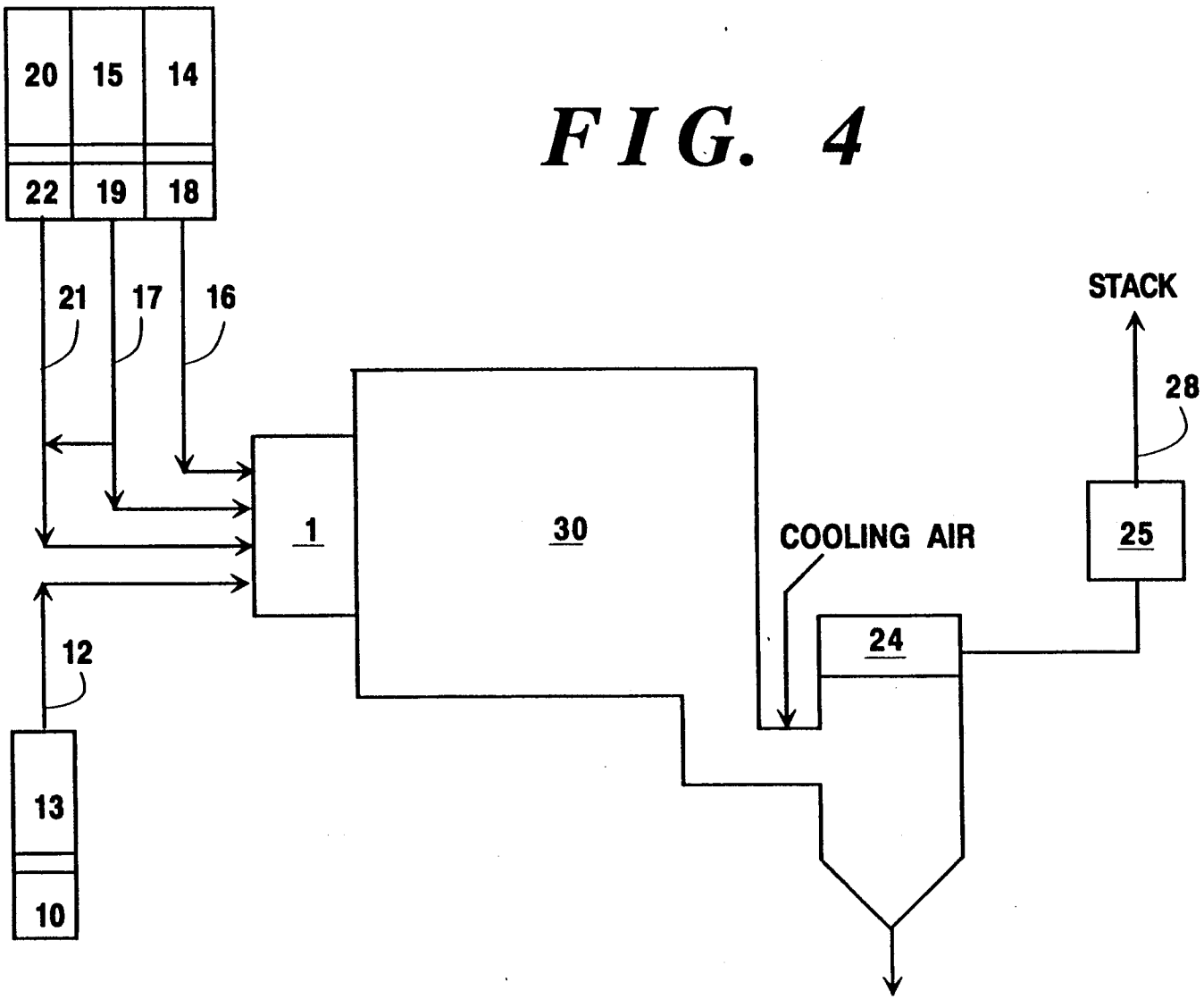
FIGS. 4 and 5 are diagrammatic views of an incineration system according to one embodiment of the present invention.
Figure 5:
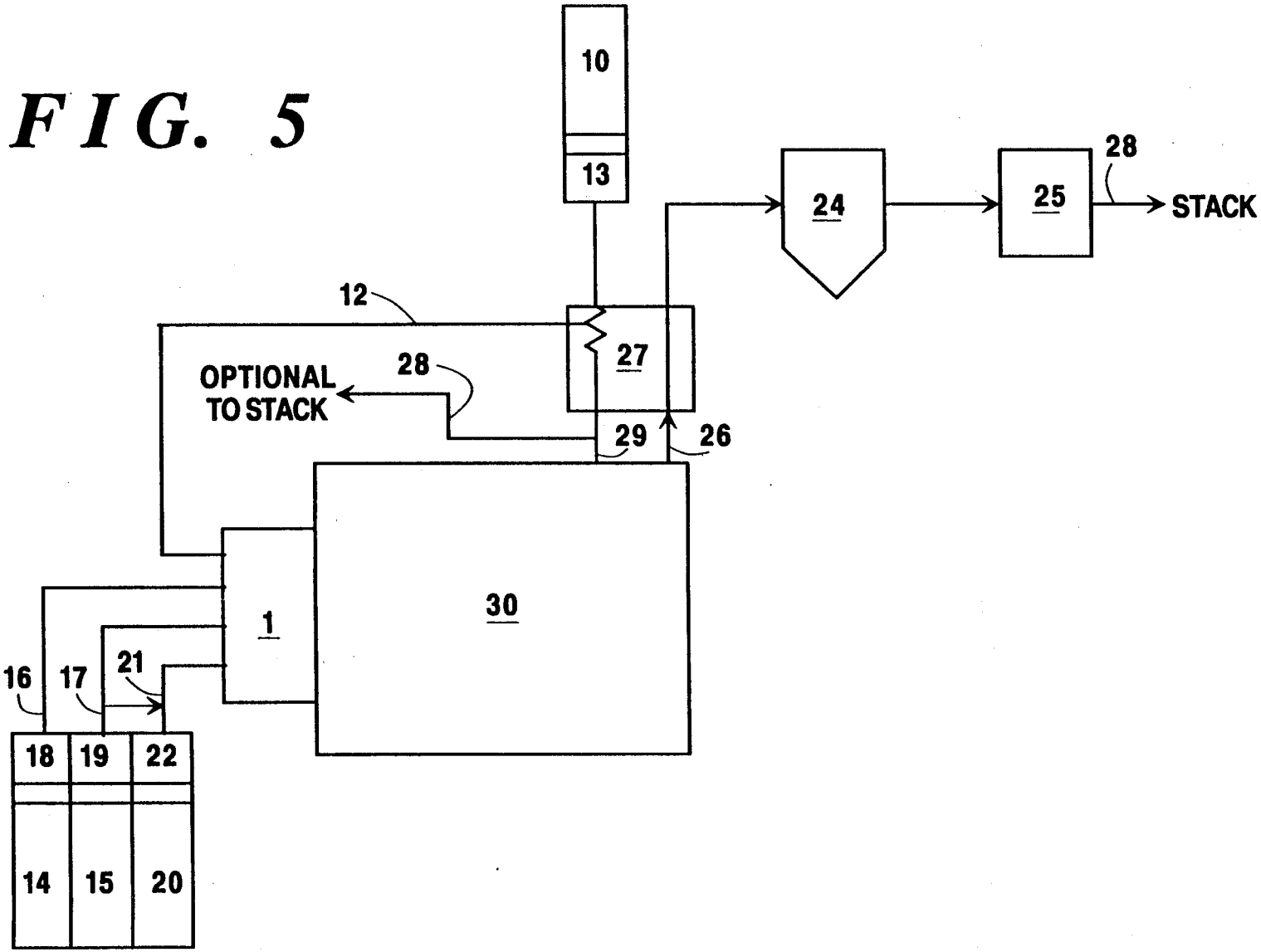

In FIGS. 4 and 5, a fluid waste stream, preferably a liquid containing waste stream, is introduced from a waste source (10) into a furnace (30) via conduits (12) and the plurality of nozzles (3) of the burner system (1). The flow rate of the fluid waste can be adjusted and/or controlled by a regulating means (13).

For instance, the plurality of nozzles (3) can be pressurized to atomize the liquid containing waste into the furnace (30) at about 0 to about 10,000 liters/hour or more. Each liquid waste stream going through the nozzles (3) could contain from about 0 to about 95% by volume water or more, the remaining content of the liquid waste stream comprising bio- and non-biodegradable components which may be hazardous to the environment.

Fuel, such as high heating value waste, oil or natural gas, and oxidant are also shown to be supplied to the burner system (1) from a fuel source (14) and an oxidant source (15) via conduits (16) and (17), respectively, to operate the oxygen/fuel burner (2). The fuel is supplied to the inner pipe (8) of the oxygen/fuel burner (2) and the oxidant is supplied to the pipe (6) through the annulus (11) of the oxygen/fuel burner (2). The rates at which said fuel and oxidant are supplied to the oxygen/fuel burner are controlled by regulating means (18) and (19), respectively. The amount of said fuel and oxidant used is generally dependent on the amount and the content of said liquid waste fed to the furnace (30). Said oxidant, however, is preferably fed at about 0 to 1000 $Nm^3/h$ or more while the fuel, such as natural gas or oil or a high heating value waste, is introduced at about 100 to 2000 $Nm^3/h$ (natural gas) or at about 80 to 1600 liters/hour (oil or waste) or more.

Furthermore, additional oxidant, such as air, oxygen enriched air or oxygen, can be introduced into the furnace (30) from an additional oxidant source (20) or from the existing oxidant source (15) via a conduit (21) and the annulus (4) of the burner system (1) as shown in FIGS. 4 and 5. The size of the annulus (4) is such that the oxidant can be introduced to the furnace (30) at about 10,000 to 70,000 $Nm^3/h$ or more. The flow rate of the latter oxidant provided through the annulus (4) is regulated by a regulating means (22). Ribs or baffles (23) may be provided within the annulus (4) to impart a whirling effect to oxidant passing through the annulus (4).

During the incineration, the flame energy is regulated or adjusted in order to prevent the flame front from escaping the furnace (30) and to control the temperature of the furnace (30), meaning e.g. that one part of fuel, such as high heating liquid waste or fossil fuel, is used together with 9 parts of low heating value aqueous waste. This ratio is generally adjusted to 1/9 to about ¼ based on weight. The ratio, however, is largely dependent on the heating value of a fluid waste stream and its introduction rate. When, for example, a temperature is decreased as a consequence of increased low heating aqueous liquid waste introduction rate and its associated water evaporation rate, a proportional increase in the high heating value waste or fossil fuel introduction rate is needed to compensate for the temperature decrease resulting from a high volume of water. The increased amount of fuel, such as high heating value liquid or gaseous waste or fossil fuel, contributes to an increase in the oxygen flame energy which is necessary to incinerate a given amount of a specific low heating value aqueous liquid waste.

Preferably, the low heating value fluid waste is introduced at about 4000 to 9000 kg/h while the oxygen flame energy employed is about 3500 to about 10,000 kcal/kg employing about 1000 kg/hr fossil oil or about 1200 $Nm^3/hr$ natural gas or about 1400 kg/hr high heating value fluid waste with corresponding oxygen flow rate of about 300 to 1000 $Nm^3$/hour. Additional air or oxygen enriched air is added through the oxygen/fuel burner at a rate between 10,000 and 70,000 $Nm^3/hr$. The rates at which fluid waste, fuel and oxidant are fed are usually limited by the volume of the resulting flue gas, which the furnace and the downstream flue gas treatment means can handle or accommodate.

Commonly, as shown in FIG. 4, the resulting flue gas from incinerating the fluid waste in furnace (30) is initially cooled by diluting it with air. The cooled flue gas is then treated in filtering means (24) and gas treating systems (25) to remove dust and pollutants such as CO, $SO_2$, $NO_X$ and/or $Cl_2$, respectively. The treated flue gas is sent to the atmosphere via a stack over the conduit (28).

As shown in FIG. 5, the hot flue gas can also be used, prior to the removal of pollutants, to heat the low heating value fluid waste. When, for example, a low heating liquid containing waste is involved, it may be partially concentrated during the heating because a portion of its water is evaporated. The hot flue gas is transported via a conduit means (26) to an evaporator system (27) which may include at least one direct or indirect, or conor countercurrent evaporator or heat exchanger. The resulting fluid waste, particularly the concentrated liquid waste from the evaporation system (27), is fed into furnace (30) via conduits (12) and the plurality of nozzles (3). The evaporated water from the evaporation system (27) can be released straight to the atmosphere via a stack. When the evaporated water contains a small amount of evaporated waste products, it is preferably sent back to furnace (30) over the conduit (29).

By using the above evaporation system with an oxygen burner in a waste incinerator, the energy required can be substantially reduced. As compared to an incinerator having air burners without an evaporation system, the fuel energy requirement may be reduced by about $4.5\times10^9$ cal. As compared to an incinerator having pure oxygen burners but no evaporation system, the fuel energy requirement may be reduced by about $1.26\times10^9$ cal. As compared to an incinerator having pure oxygen burners which uses a concentrated liquid waste, the fuel energy requirement may still be reduced by about $0.58\times10^9$ cal. This reduction in the energy requirement is based on 1 ton of low heating value aqueous liquid waste using thermodynamical calculations. Incinerators, by use of the above evaporation system with an oxygen burner, can be operated with 87% less energy. As a result of a less energy requirement, the amount of fuel or oxygen employed can be substantially reduced while maximizing the rate at which a low heating value waste is incinerated.

The following examples serve to illustrate the invention. They are presented for illustrative purposes and are not intended to be limiting.

EXAMPLE 1

A liquid waste was simulated by a 20 percent by weight ethanol in water solution. This simulated liquid waste was fed to an incinerator operating at about 1150° C. via a burner system having liquid waste atomizing means. The burner system included a centrally positioned water cooled oxygen/oil burner and a water cooled annulus formed by a cylindrical housing means having a water jacket surrounding the centrally positioned oxygen/oil burner. Around this centrally positioned oxygen/oil burner, three nozzles were placed within the annulus substantially parallel to the oxygen/oil burner. The oxygen/oil burner used about 45 liters/hour light oil with a corresponding oxygen flow of 100 $Nm^3/h$ ($Nm^3$ means cubic meter at 0° C. and 760 mm Hg) and produced a flame having a length of about 1.5 m. To this flame, the liquid waste was atomized at 400 liters/hour via the three pressure nozzles which were $N_2$ pressurized at about 6 barg. Each nozzle was located at about 5 cm away from the center of the burner system with its tip terminating at about 3 cm in front of the tip of the oxygen/fuel burner. Also, additional oxygen was added through the annulus at about 200 $Nm^3/h$ to enhance the stability of the flame and the burning of the simulated liquid waste. During the incineration, the flame of the oxygen/oil burner became darker and about 2.5 m long. The flame, however, was stable and remained within the incinerator. Moreover, no typical ethanol odor was detected from the resulting flue gas and the burner system including the nozzles remained in perfect condition.

EXAMPLE 2

A liquid waste was simulated by a 25% by weight glycol and 75% by a weight water mixture and was fed at 300 liters/hour to an incinerator which was held at 1070° C. The burner system employed to heat and feed the liquid waste in the incinerator was identical to the one used in Example 1 except that the nozzles were bent inwardly at a 30° angle, measured from the central axis of each nozzle. The oxygen/oil burner was operated to provide a flame having a length of about 1.5 m by using about 50 liters oil/hour with a corresponding oxygen flow of 100 $Nm^3$/hour. Additional oxygen was added through the annulus at about 400 $Nm^3/h$. During the incineration, the flame of the oxygen/oil burner became darker and longer and reached 2.5 m but remained stable and was kept within the incinerator. Moreover, the glycol was completely burned in spite of its very low vapor pressure which renders its evaporating very difficult.

EXAMPLE 3

In an industrial incinerator, a burner system (1) as described in FIG. 2, having 4 liquid waste nozzles has been used. This burner was installed in a rotary incinerator having a length of about 10 m and an inside diameter of about 2.5 m.

The off-gases (the flue gas resulting from burning the waste) of this incinerator at about 1000° C. passed through a waste heat boiler with a steam producing capacity of about 20T/hr, which cooled the off-gases to about 240° C. The cooled off-gases then passed through a dust removal system and an acid neutralizing system before being released to the atmosphere.

Through the central oxy-burner (2) about 600 kg/hr high heating value waste passed through the nozzle tip (7) and was ignited with about 400 $Nm^3$ $O_2$/hr passing through the annulus (11). The high heating value waste was atomized by about 30 $Nm^3$ air/hr. The four nozzles (3) dispersed a low heating value waste at a total rate of about 6000 l/hr into the oxy-flame located at the nozzle tip (7).

Additional oxidant, air, was delivered through the annulus (4) at a rate of about 50,000 $Nm^3/hr$ to stabilize the flame and burn the wastes. Solid waste at a rate of about 1000 kg/hr was introduced separately through a special inlet into the incinerator.

The temperature at the outlet of the incinerator was regulated around 1000° C. by varying the rate of both the high and low heating value wastes. The off-gas has an oxygen content of over 12%.

The above experiments showed that a rate at which a liquid waste can be incinerated can be increased by about 30% when using the oxygen/fuel burner system above instead of a conventional air-burner system. Also, less fouling of the steam pipes in the waste heat boiler was experienced compared to the conventional air burner system, indicating that a full and better burn-off of the waste products is achieved with this specific oxygen technique.

The present invention provides an improvement in increasing the throughput capacity of a fluid waste incinerator. By dispersing the fluid waste into the flame of at least one oxygen/fuel burner via nozzle means at a controlled rate, the temperature of an incinerator can be cooled to the requisite range. Thus, the temperature of the incinerator can be controlled by regulating the flame energy by adjusting a fuel to low heating value waste ratio to accommodate a high throughput. Moreover, the flame front is well contained within the incinerator even at a high throughput because this incineration process takes place in and around the flame of the oxygen/fuel burner. The presence of the fluid waste in and around this flame, at the same time, does not adversely affect the incineration process. Furthermore, a low quantity of flue gas is produced as a result of using the oxygen/fuel burner since $N_2$ which is contained in the air has been reduced or eliminated when partially or totally replacing this air by the oxygen employed in the oxygen/fuel burner. This, in turn, also allows to increase the throughput of an incinerator. Finally, by using the available heat of the flue gas coming from the incinerator to concentrate a liquid containing waste, the amount of fuel and oxidant requirement can be dramatically reduced with increased throughput of said waste incineration.

Although the process of this invention has been described in detail with reference to certain embodiments, those skilled in the art will recognize that there are other embodiments of the invention within the spirit and scope of the claims.

What is claimed is:

1. A process for controlling the temperature and flame front in a waste incinerator comprising: dispersing low heating value fluid waste into the flame of at least one oxygen/fuel burner, which uses an oxidant having at least about 28% oxygen concentration, to incinerate the low heating value fluid waste in and around the flame, wherein flame energy is adjusted or regulated to confine the flame front within said incinerator and to maintain a preselected temperature in said incinerator.

2. A process according to claim 1, wherein said fluid waste is dispersed via at least one nozzle means placed within an annulus which is formed by a housing means surrounding said at least one oxygen/fuel burner.

3. A process according to claim 2, wherein said fluid waste comprises liquid waste.

4. A process according to claim 2, wherein oxidant is introduced through said annulus.

5. A process according to claim 2, wherein said at least one nozzle means is bent inwardly such that said fluid waste is dispersed directly into the flame of said at least one oxygen/fuel burner.

6. A process according to claim 3, wherein said fluid waste is preheated and partially concentrated with the resulting flue gas from said incinerator before said fluid waste is introduced into said incinerator.

7. A process according to claim 1, wherein said flame energy is regulated by adjusting a fuel/waste ratio within the range from about 1/9 to about ¼.

8. A process according to claim 7, wherein the total fluid waste introduction rate is within the range of about 1000 to about 10,000 kg/hour.

9. A process according to claim 1, wherein said fluid waste contains from about 0% to 95% by volume water.

10. A process according to claim 4, wherein means for imparting a whirling effect to said oxidant is provided within said annulus.

11. A process according to claim 1, wherein said fluid waste comprises gaseous waste.

12. A process according to claim 1, wherein said fluid waste comprises a mixture of liquid and gaseous waste, each of which being separately dispersed into the flame of said at least one oxygen/fuel burner through at least one nozzle of said at least one nozzle means.

13. A process for incinerating fluid waste in a combustion zone which comprises: providing a burner system having at least one oxygen/fuel burner, which uses an oxidant having at least about 28% oxygen concentration, and a plurality of nozzle means, said plurality of nozzle means being placed within an annulus which is formed by a housing means surrounding said at least one oxygen/fuel burner, dispersing the fluid waste via said plurality of nozzle means into the flame of said at least one oxygen/fuel burner and providing oxidant annularly around said fluid waste through said annulus.

14. A process for incinerating fluid waste according to claim 13, wherein said fluid waste is liquid waste, gaseous waste and mixtures thereof, each of said waste being fed through separate nozzles of said plurality of nozzle means.

15. A process for incinerating liquid waste in a combustion zone comprising; atomizing said liquid waste into the flame of at least one centrally positioned oxygen/fuel burner, which uses an oxidant having at least about 28% oxygen concentration, via at least one nozzle means disposed around said at least one centrally positioned oxygen/fuel burner and providing oxidant annularly to the atomized liquid waste through an annulus which is formed by a housing means surrounding said at least one oxygen/fuel burner and said at least one nozzle means.

16. A process according to claim 15, wherein the liquid waste atomizing rate to the fuel introduction rate ratio is adjusted such that the flame temperature and flame front are controlled to prevent the flame from damaging the combustion zone and from escaping the combustion zone.

17. A process according to claim 15, where said combustion zone is contained in a fixed furnace.

18. A process according to claim 15, where said combustion zone is contained in a rotating furnace.

19. A process according to claim 15, where said at least one nozzle means is bent inwardly such that said liquid waste is sprayed into the flame of said at least one oxygen burner.

20. A waste burner system comprising; at least one water cooled oxygen/fuel burner and at least one nozzle means mounted around said at least one oxygen/fuel burner within a housing means having a water jacket, which surrounds said at least one oxygen/fuel burner, wherein said at least one water cooled oxygen/fuel burner comprises a cylindrical water cooled pipe and a concentrically placed pipe, said pipes forming passageways to accommodate fuel and oxidant.

21. A waste burner system according to claim 20, wherein said at least one nozzle means is bent toward said at least one oxygen/fuel burner.

22. A waste burner system according to claim 20, wherein said at least one nozzle means is in communication with at least one fluid waste source.

23. A waste incineration system comprising:

a burner system having means for engendering a flame and means for dispersing the fluid waste into said flame in a furnace;

one or more conduit means for transporting said fluid waste from a fluid waste source to said means for dispersing the fluid waste;

a flue gas treating means in communication with the furnace to remove pollutants in the flue gas resulting from burning the fluid wastes in the furnace; and a means for transporting the flue gas from the furnace to heat the said fluid waste prior to dispersing fluid waste into the flame.

24. A waste incineration system according to claim 23 wherein said means for transporting the flue gas to heat the said fluid waste prior to dispersing said fluid comprises an evaporation system which is used to partially concentrate the waste.

25. A waste incineration system according to claim 23, wherein said burner system comprises at least one oxygen/fuel burner for engendering said flame and at least one nozzle means for dispersing the fluid waste, said at least one nozzle means placed within an annulus which is formed by housing means surrounding said at least one oxygen/fuel burner.

26. A waste incineration system according to claim 23, further comprising at least one additional conduit means for transporting said fluid waste or fuel from a fuel or fluid waste source to said means for engendering said flame, wherein the placement of said means for dispersing the fluid waste is such that the waste is directed toward said flame.

27. A waste burner system according to claim 20, wherein said concentrically placed pipe comprises at least two coaxially placed tubes.

28. A process according to claim 1, further comprising introducing solid waste into said incinerator.

* * * * *